US008873791B2

(12) United States Patent
Yang

(10) Patent No.: US 8,873,791 B2
(45) Date of Patent: Oct. 28, 2014

(54) EARPHONE

(71) Applicant: Bill Yang, Taipei (TW)

(72) Inventor: Bill Yang, Taipei (TW)

(73) Assignee: Cotron Corporation, Taipei (TW)

( * ) Notice: Subject to any disclaimer, the term of this patent is extended or adjusted under 35 U.S.C. 154(b) by 0 days.

(21) Appl. No.: 13/974,059

(22) Filed: Aug. 23, 2013

(65) Prior Publication Data

US 2014/0226847 A1 Aug. 14, 2014

(30) Foreign Application Priority Data

Feb. 8, 2013 (TW) ..... 102105329 A

(51) Int. Cl.
*H04R 25/00* (2006.01)

(52) U.S. Cl.
USPC ..... 381/373; 381/370; 381/372

(58) Field of Classification Search
USPC ..... 381/370–374, 376–380
See application file for complete search history.

(56) References Cited

U.S. PATENT DOCUMENTS 6,826,287 B2 * 11/2004 Myers ..... 381/373
7,391,878 B2 * 6/2008 Liao ..... 381/373
8,515,116 B2 * 8/2013 Lee ..... 381/373

* cited by examiner

*Primary Examiner* — Suhan Ni
(74) *Attorney, Agent, or Firm* — Jianq Chyun IP Office

(57) ABSTRACT

An earphone including a housing, a speaker, a plurality of porous materials and a tuning mechanism is provided. The housing has a containing space, a sound-output opening and a plurality of tuning holes, wherein the containing space communicates with outside of the housing through the tuning holes. Areas of the tuning holes are substantially the same. The speaker is disposed at the sound-output opening and located in the containing space. The air permeability of each porous material are different, and the porous materials cover the tuning holes correspondingly. The tuning mechanism is disposed at the housing and shields at least one of the tuning holes selectively.

16 Claims, 8 Drawing Sheets

EARPHONE

CROSS-REFERENCE TO RELATED APPLICATION

This application claims the priority benefit of Taiwan application serial no. 102105329, filed on Feb. 8, 2013. The entirety of the above-mentioned patent application is hereby incorporated by reference herein and made a part of this specification.

FIELD OF THE INVENTION

The present invention relates to an earphone, and more particularly, to the one that has a sound tuning function.

DESCRIPTION OF RELATED ART

With the rapid progress in science and technology, all electronic products have been developed towards light, handy and miniaturized designs. People may use miniaturized electronic products, such as radios or walkmans, anytime and anywhere. Moreover, since personal digital products gradually become popular, products such as common MP3 walkmans, cellular phones, personal digital assistants (PDA) or notebooks, have even grown to be indispensable in our daily life. In addition, the cell phone integrated with functions of both radio and MP3 has come out.

For each of those aforementioned electronic products, in order to allow a user to listen to the audio information provided by the electronic product without disturbing the other people around, an earphone has become a necessary accessory to the electronic product. Moreover, the earphone also provides a listener better audio transmission so that the listener can clearly hear and understand content of the audio information. In contrast to unclear audio transmission through the air, especially when the listener is moving, for example like doing exercises, driving, intensely moving around or being in a noisy environment, the audio transmission of the earphone still would not be affected.

However, since the size and structure of the ear and the ear canal are different from person to person, and a different person has a different favor for the music, thus, the judgment for the sound quality of the earphone varies as for different persons, and it is hard to meet the requirements of every single person. Meanwhile, the frequency response curve of most earphones available in the market is fixed, and if the frequency response on high tone portion or low tone portion of the signal is to be changed, it requires changing the distribution characteristics of the sound field by an electronic equalizer or relevant software. Even though the additional electronic equalizer may change the frequency response of the earphone, the time delay caused by the inductance or capacitance within the electronic equalizer cannot be compensated. Therefore, it is an unavoidable task to improve the structure of the earphone.

SUMMARY OF THE INVENTION

The invention provides an earphone capable for adjusting the sound field characteristic in the structure of the earphone.

The earphone of the present invention includes a first housing, a speaker, a plurality of porous materials and a tuning mechanism. The first housing has a containing space, a sound-output opening and a plurality of tuning holes, wherein the containing space communicates with outside of the first housing through the tuning holes. The areas of the tuning holes are substantially the same. The speaker is disposed at the sound-output opening and located in the containing space. The an air permeability of each porous material are different and the porous materials cover the tuning holes correspondingly. The tuning mechanism is disposed at the first housing and shields at least one of the tuning holes selectively.

The earphone of the present invention includes a first housing, a speaker, a plurality of porous materials and a tuning mechanism. The first housing has a containing space, a sound-output opening and a first tuning hole, wherein the containing space communicates with outside of the first housing through the first tuning hole. The speaker is disposed at the sound-output opening and located in the containing space. An air permeability of each porous material are different. The tuning mechanism is disposed at the first housing and has a plurality of second tuning holes. The areas of the second tuning holes are substantially the same, and the porous materials cover the second tuning holes correspondingly. The tuning mechanism aligns one of the second tuning holes with the first tuning hole selectively.

In light of the above, since the sound field characteristic may be different due to the air permeability of the tuning holes, the air permeability of each tuning hole is changed by selectively shielding with the porous materials having different air permeability in the present invention, and a suitable air permeability of tuning hole is selected through the tuning mechanism according to the user's preference. Therefore, each person may adjust the frequency response of the earphone according to the user's preference, such that the earphone can meet different users' requirements and it enhances the performance of the earphone.

To make the above features and advantages of the present invention more comprehensible, several embodiments accompanied with drawings are described in detail as follows.

DESCRIPTION OF EMBODIMENTS

Figure 1:
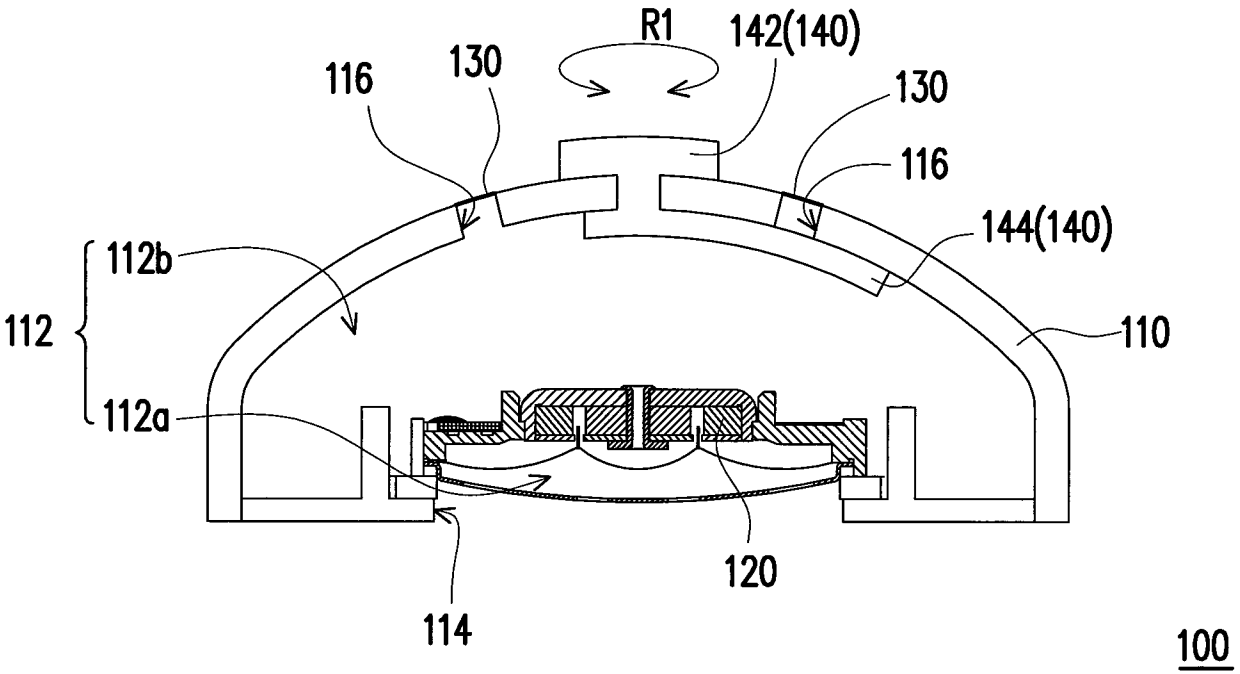
FIG. 1 is a schematic cross-sectional view illustrating an earphone according to one embodiment of the present invention.
Figure 2:
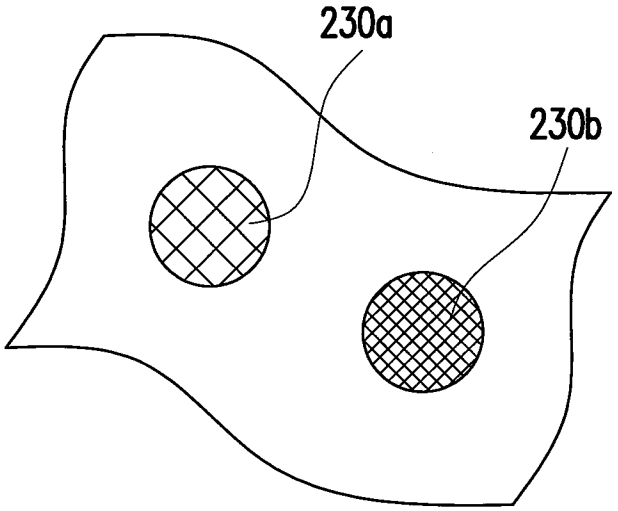
FIG. 2 is a schematic view illustrating the tuning hole cover the porous material according to one embodiment of the present invention.

FIG. 1 is a schematic cross-sectional view illustrating an earphone according to one embodiment of the present invention. FIG. 2 is a schematic view illustrating the tuning hole cover the porous material according to one embodiment of the present invention. Referring to FIG. 1 and FIG. 2 together, the earphone 100 of the present embodiment includes a first housing 110, a speaker 120, a plurality of porous materials 130 and a tuning mechanism 140. The first housing 110 has a containing space 112, a sound-output opening 114 and a plurality of tuning holes 116. The speaker 120 is disposed at the sound-output opening 114 and located in the containing space 112, and the containing space 112 communicates with the outside of the first housing 110 through the tuning holes 116. In the embodiment, as shown in FIG. 1, the containing space 112 is partitioned into a front chamber 112*a* and a back chamber 112*b* by the speaker 120. The sound-output opening 114 is located at the front chamber 112*a*, while the back chamber 112*b* is used for generating a resonance effect. The tuning holes 116 are used for communicating the back chamber 112*b* of the containing space 112 with the outside of the first housing 110, so as to adjust the sound field characteristic of the earphone 100.

As described above, the areas of the tuning holes 116 are substantially the same to keep the same reflection effect from the first housing 110. Each porous material 130 correspondingly covers one tuning hole 116, and the air permeability of the porous materials 130 which cover different tuning holes 116 are different. The tuning mechanism 140 is disposed at the first housing 110 and shields at least one of the tuning holes 116 selectively. For instance, as shown in FIG. 2, the porous material includes a first porous material 230*a* and a second porous material 230*b*, and the air permeability of the first porous material 230*a* is larger than the air permeability of the second porous material 230*b*. Certainly, FIG. 2 is just illustrated as an example, the quantity of the tuning holes and the porous materials and the design of air permeability of different porous materials corresponding to different tuning holes are not limited in the present invention. The porous materials of the embodiment serve as an acoustic damper of a common earphone. According to the present embodiment, the material of the porous material is cloth, long fiber paper, foam, or the like.

In general, the tuning hole with smaller air permeability is more outstanding for the frequency response of the high-frequency portion, and the tuning hole with larger air permeability is more outstanding for the frequency response of the low-frequency portion. In other words, different air permeability of the tuning holes are different in the sound field characteristic and have their own particularity. Therefore, different tuning holes correspondingly cover different air permeability of the porous materials in the present invention, so as to change the air permeability of each tuning hole. Through the tuning mechanism disposed at the first housing, some of the tuning holes are selectively shielded and to-be-selected tuning hole is exposed. As such, the user can adjust the sound field characteristic of the earphone as required, thus the performance of the earphone is improved.

Specifically, as shown in FIG. 1, the tuning mechanism 140 includes a cover 144 and a control button 142. The control button 142 protrudes to the outside of the first housing 110. The control button 142 is connected and used for driving the cover 144 to shield at least one of the tuning holes 116. In the embodiment, the tuning holes 116 are disposed in a manner of surrounding the control button 142, for example. The control button 142 protrudes to the outside of the first housing 110 and is connected to the cover 144 which is located in the first housing 110. As such, once the user rotates the control button 142 along a rotation direction R1, the cover 144 is driven to rotate along the rotation direction R1 to be in a tuning position as shown in FIG. 1, so as to shield at least one of the tuning holes 116 (the tuning hole located at the right side of the control button) and expose the selected tuning hole (the tuning hole located at the left side of the control button). Undoubtedly, the design of the tuning mechanism 140 of FIG. 1 is just for explanation, which is however not limited in the present invention. In other embodiments of the present invention, it is also possible that the cover exposes only one tuning hole, and the cover also can expose a plurality of tuning holes simultaneously according to actual product requirements.

Figure 3:
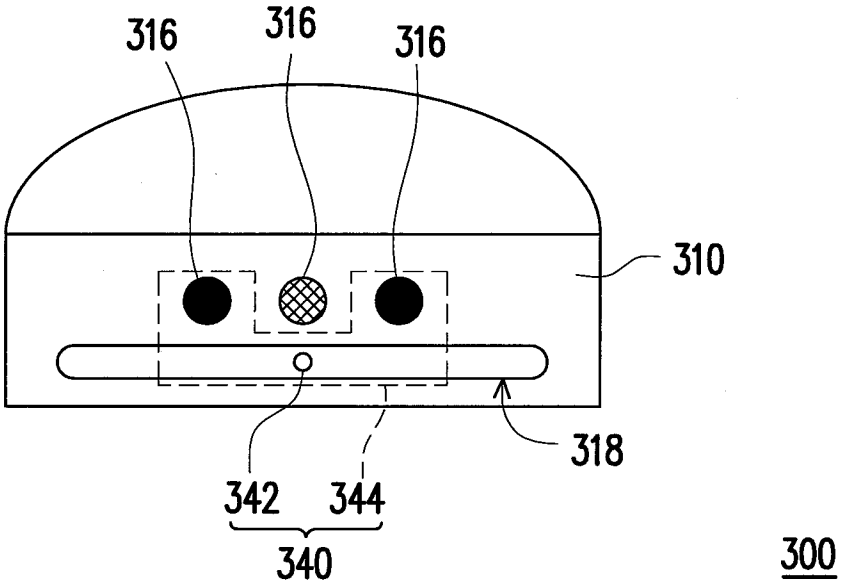
FIG. 3 is an external schematic view illustrating an earphone according to another embodiment of the present invention.

FIG. 3 is an external schematic view illustrating an earphone according to another embodiment of the present invention. It has to be mentioned that, the earphone 300 of the present embodiment is substantially similar to the earphone 100 of FIG. 1. Therefore, reference numerals the same as that of the above embodiment are used in this embodiment to indicate similar components, and other similar features of the relevant technology will not be repeated herein any more. For a detailed description of this section, reference can be found in the abovementioned embodiment of the invention, therefore no further description is contained herein. Referring to FIG. 3, the tuning holes 316 of the embodiment are disposed at the side of the first housing 310 and communicate the back chamber of the containing space (the back chamber 112*b* partitioned by the speaker 120 as shown in FIG. 1) with the outside of the first housing 310. The tuning holes 316 correspondingly cover the different air permeability of the porous materials (e.g., the porous materials 230*a*, 230*b* as shown in FIG. 2). In the embodiment, the first housing 310 further includes a sliding slot 318, and the tuning mechanism 340 includes a cover 344 and a control button 342. The control button 342 is connected to the cover 344 which is located in the first housing 310 and protrudes to the outside of the first housing 310 via the sliding slot 318, so as to move along the sliding slot 318. As such, once the user rotates the control button 342 along the sliding slot 318, the cover 344 is driven to rotate to be in a tuning position as shown in FIG. 3, so as to shield at least one of the tuning holes 316 (the tuning holes located at two sides) and expose the selected tuning hole (the tuning hole located in the middle). Undoubtedly, the design of the tuning mechanism 340 of FIG. 3 is just for explanation, which is however not limited in the present invention. In other embodiments of the present invention, it is also possible that the control button 342 does not protrude to the outside of the first housing 310 and is just exposed outside the first housing 310, for example, the control button 342 can be replaced by a recess formed on the cover 344, so as to facilitate the user to move the cover 344 through the recess. As long as the tuning mechanism is disposed at the first housing and shields at least one of the tuning holes selectively, the design would fall within the scope of the present invention.

Figure 4:
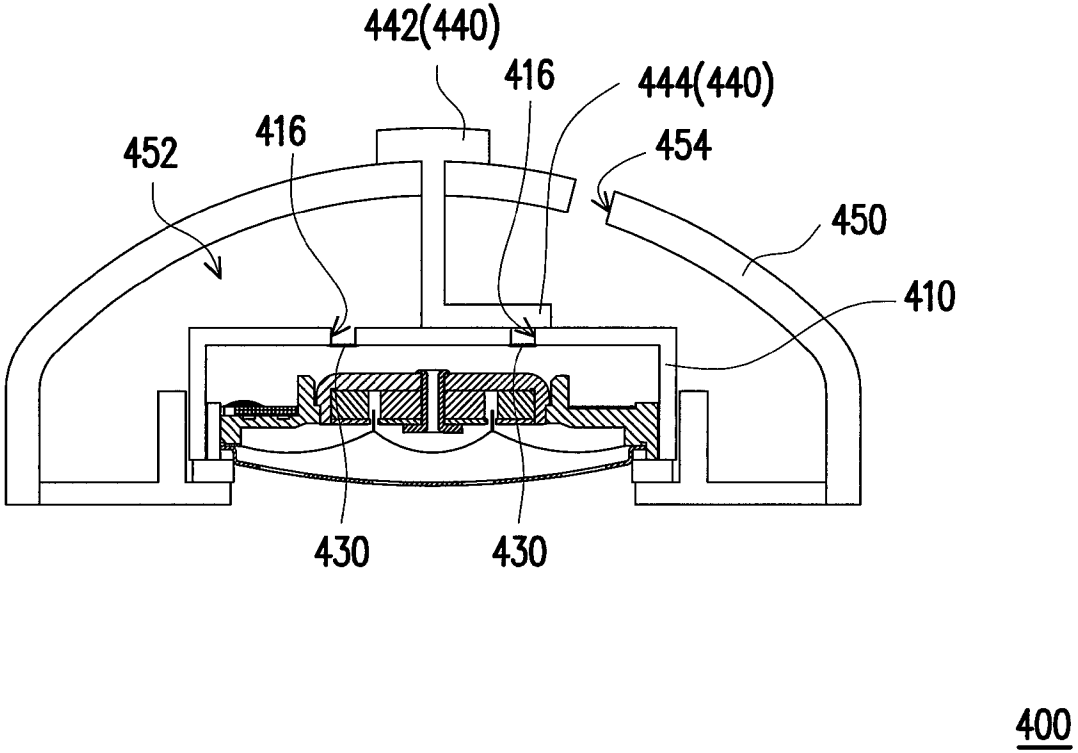
FIG. 4 is a schematic cross-sectional view illustrating an earphone according to another embodiment of the present invention.

FIG. 4 is a schematic cross-sectional view illustrating an earphone according to another embodiment of the present invention. It has to be mentioned that, the earphone 400 of the present embodiment is substantially similar to the earphone 100 of FIG. 1. Therefore, reference numerals the same as that of the above embodiment are used in this embodiment to indicate similar components, and other similar features of the relevant technology will not be repeated herein any more. For a detailed description of this section, reference can be found in the abovementioned embodiment of the invention, therefore no further description is contained herein. Referring to FIG. 4, in the embodiment, the earphone 400 further includes a second housing 450 covering outside the first housing 410 and forming an external chamber 452 with the first housing 410. The tuning mechanism 440 includes a control button 442 and a cover 444, wherein the control button 442 protrudes to the outside of the second housing 450, and the cover 444 is located on the first housing 410 and connected to the control button 442. In such configuration, through the control button 442 the user can drive the cover 444 to rotate to be in a tuning position as shown in FIG. 4, so as to shield at least one of the tuning holes 416 (the tuning holes located at the right side) and expose the selected tuning hole (the tuning hole located at the left side). Undoubtedly, the tuning mechanism 440 of FIG. 4 is just for explanation, which is however not limited in the present invention. As long as the control button of the tuning mechanism is exposed outside the second housing and connected to the cover which is located on the first housing and the control button can drive the cover to shield at least one of the tuning holes, the design would fall within the scope of the present invention. The second housing 450 may further comprise a vent 454, and the external chamber 452 communicates with outside of the second housing 450 through the vent 454. The earphones of other embodiments of the present application may comprise vents at housings, too.

Figure 5:
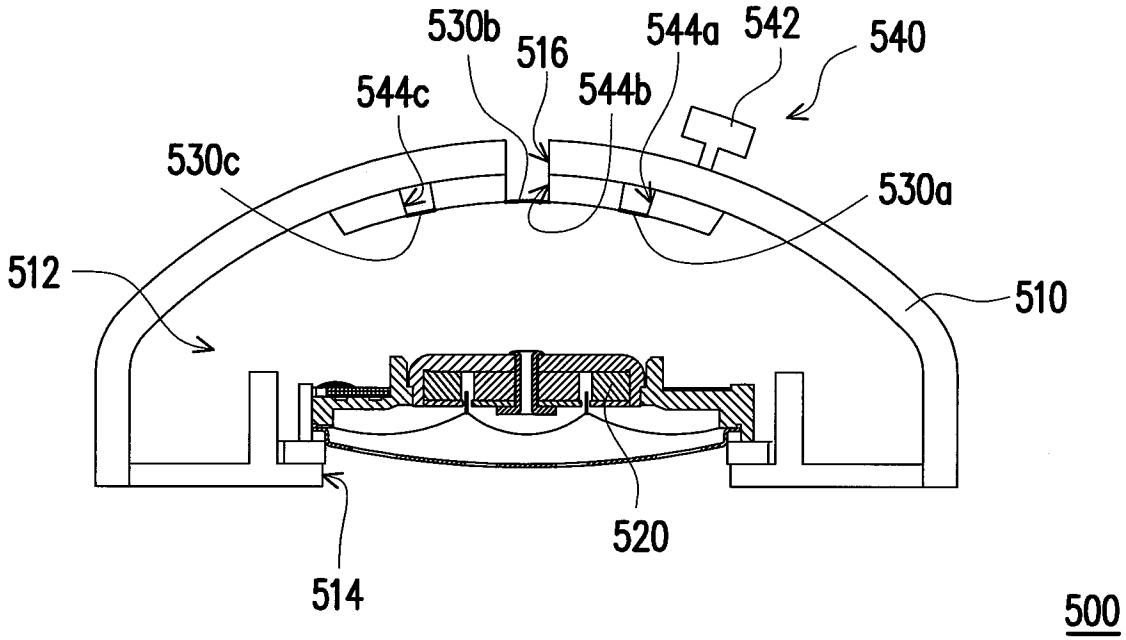
FIG. 5 is a schematic cross-sectional view illustrating an earphone according to another embodiment of the present invention.
Figure 6:
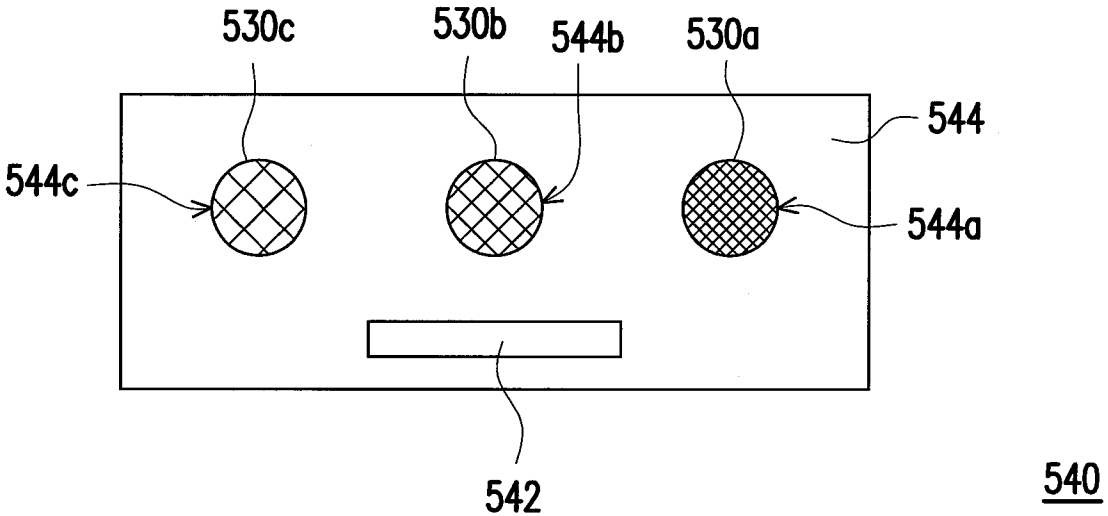
FIG. 6 is a schematic view of the tuning mechanism of FIG. 5.

FIG. 5 is a schematic cross-sectional view illustrating an earphone according to another embodiment of the present invention. FIG. 6 is a schematic view of the tuning mechanism of FIG. 5. It has to be mentioned that, the earphone 500 of the present embodiment is substantially similar to the earphone 100 of FIG. 1. Therefore, reference numerals the same as that of the above embodiment are used in this embodiment to indicate similar components, and other similar features of the relevant technology will not be repeated herein any more. For a detailed description of this section, reference can be found in the abovementioned embodiment of the invention, therefore no further description is contained herein. Referring to FIG. 5 and FIG. 6 together, the earphone 500 of the present embodiment includes a first housing 510, a speaker 520, a plurality of porous materials 530*a*, 530*b*, 530*c* and a tuning mechanism 540. The first housing 510 has a containing space 512, a sound-output opening 514 and a tuning hole 516. The speaker 520 is disposed at the sound-output opening 514 and located in the containing space 512, and the containing space 512 communicates with the outside of the first housing 510 through the tuning hole 516, so as to adjust the sound field characteristic of the earphone 500. The air permeability of each porous material 530*a*, 530*b*, and 530*c* are different as shown in FIG. 6. The air permeability of each porous material 530*a*, 530*b*, and 530*c* may be determined by different voids of each porous material 530*a*, 530*b*, and 530*c*. The tuning mechanism 540 is disposed at the first housing 510 and has a plurality of second tuning holes 544*a*, 544*b*, and 544*c*. The areas of the second tuning holes 544*a*, 544*b*, and 544*c* are substantially the same to keep the same reflection effect from the first housing 510 and the porous materials 530*a*, 530*b*, and 530*c* cover the second tuning holes 544*a*, 544*b*, and 544*c* correspondingly. As shown in FIG. 5, the tuning mechanism 540 aligns one of the second tuning holes 544*a*, 544*b*, and 544*c* (544*b* is shown) with the first tuning hole 516 selectively. As such, the user can adjust the sound field characteristic of the earphone as required, thus the performance of the earphone is improved. Certainly, FIG. 6 is just illustrated as an example, the quantity of the second tuning holes and the porous materials and the design of air permeability of each porous material are not limited in the present invention.

Specifically, as shown in FIG. 5, the tuning mechanism 540 includes a cover 544 and a control button 542. The control button 542 protrudes to the outside of the first housing 510 and the cover 544 has the abovementioned second tuning holes 544*a*, 544*b*, and 544*c*. As such, the user can just move the control button 542 to drive the cover 544 to move to a tuning position as shown in FIG. 5, so as to align the selected second tuning hole 544*b* with the first tuning hole 516, so that the porous material 530*b* which covers the selected second tuning hole 544*b* correspondingly covers the first tuning hole 516. Undoubtedly, the design of the tuning mechanism 540 of FIG. 5 is just for explanation, which is however not limited in the present invention.

Figure 7:
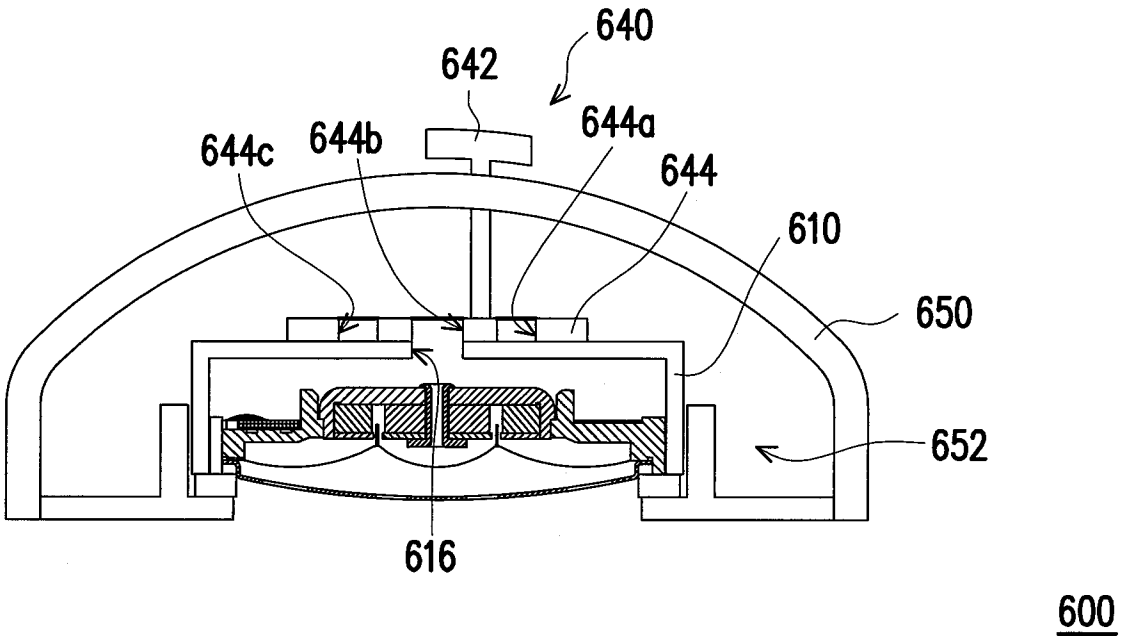
FIG. 7 is a schematic cross-sectional view illustrating an earphone according to another embodiment of the present invention.

FIG. 7 is a schematic cross-sectional view illustrating an earphone according to another embodiment of the present invention. It has to be mentioned that, the earphone 600 of the present embodiment is substantially similar to the earphone 500 of FIG. 5. Therefore, reference numerals the same as that of the above embodiment are used in this embodiment to indicate similar components, and other similar features of the relevant technology will not be repeated herein any more. For a detailed description of this section, reference can be found in the abovementioned embodiment of the invention, therefore no further description is contained herein. Referring to FIG. 7, in the embodiment, the earphone 600 further includes a second housing 650 covering outside the first housing 610 and forming an external chamber 652 with the first housing 610. The tuning mechanism 640 includes a control button 642 and a cover 644, wherein the control button 642 protrudes to the outside of the second housing 650. The cover 644 has the abovementioned second tuning holes 644*a*, 644*b*, and 644*c*, and the cover 644 is located on the first housing 610 and connected to the control button 642. In such configuration, the user can just move the control button 642 to drive the cover 644 to move to a tuning position as shown in FIG. 7, so as to align one of the second tuning holes 644*a*, 644*b*, and 644*c* (the second tuning hole 644*b* is shown) which covers different air permeability of different porous material with the first tuning hole 616. Undoubtedly, the design of the tuning mechanism 640 of FIG. 6 is just for explanation, which is however not limited in the present invention. As long as the control button of the tuning mechanism is exposed outside the second housing and connected to the cover which is located on the first housing and the control button can drive the cover to align one of the second tuning holes with the first tuning hole, the design would fall within the scope of the present invention.

The abovementioned earphones 100, 300, 400, 500, and 600 can be circum-aural earphone, wherein an arc-shaped pivoting frame is connected between the two earphone cups, and when it is worn by a user the two earphone cups cover the ears. This design can effectively insulate from external noise, thus a clear music can still be listened to even though the volume of the music is lower, and it may not cause damage to auditory nerves of the user. Obviously, the present invention is not limited thereto. In the following embodiments, the earphone can also be in-ear type earphone. In general, in-ear type earphone is that the size of the sound-output end is reduced and an earplug covers thereto, so that the sound-output end can be more deeply placed into the ear canal of the user, and elastic deformation of the earplug is used for fitting different ear canal profiles of users. A portion of the earplug of the in-ear type earphone would be placed in the ear canal of the user, and this is different than that the circum-aural earphone does not enter the ear canal of the user. This kind of earphone uses earplug to seal the ear canal of the user, so as to insulate from the external noise to improve audio quality.

Figure 8:
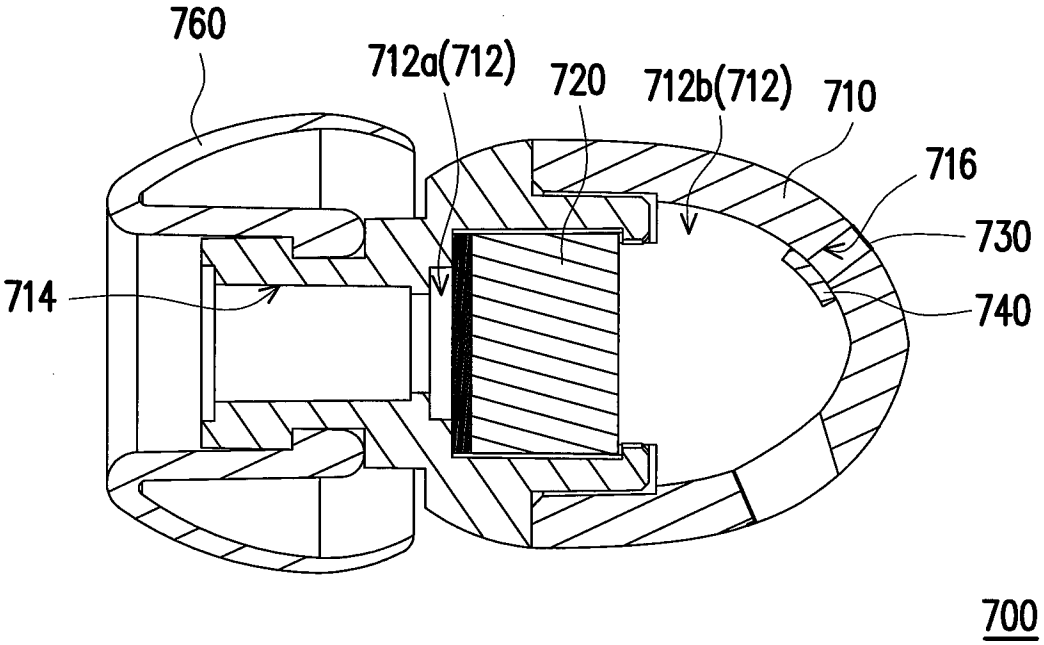
FIG. 8 is a schematic cross-sectional view illustrating an earphone according to another embodiment of the present invention.

FIG. 8 is a schematic cross-sectional view illustrating an earphone according to another embodiment of the present invention. In the embodiment, the earphone 700 is an in-ear type earphone and includes a first housing 710, a speaker 720, a plurality of porous materials 730, a tuning mechanism 740 and an earplug 760. The first housing 710 has a containing space 712, a sound-output opening 714 and a plurality of tuning holes 716. The earplug 760 is disposed around the outside of the sound-output opening 714. The speaker 720 is disposed at the sound-output opening 714 and located in the containing space 712, and the containing space 712 communicates with the outside of the first housing 710 through the tuning holes 716. The containing space 712 is partitioned into a front chamber 712*a* and a back chamber 112*b* by the speaker 720. The sound-output opening 714 is located at the front chamber 712*a*, and the back chamber 712*b* is used for generating a resonance effect. The tuning holes 716 are used for communicating between the back chamber 112*b* of the containing space 712 and the outside of the first housing 710, so as to adjust the sound field characteristic of the earphone 700.

The areas of the tuning holes 716 are substantially the same to keep the same reflection effect from the first housing 710. Each porous material 730 correspondingly covers one tuning hole 716, wherein the air permeability of the porous materials 730 which cover the different tuning holes 716 are different (similar to the porous materials 230*a*, 230*b* shown in FIG. 2). The tuning mechanism 740 is disposed at the first housing 710 as shown in FIG. 1, FIG. 3 or FIG. 4, so as to shield at least one of the tuning holes 716 selectively. Certainly, in other embodiments of the present invention, the configuration of FIG. 5 is also adapted to an in-ear type earphone, wherein by using the design in which porous materials having a plurality of different air permeability corresponding to one tuning hole, one of the porous materials covers on the tuning hole selectively by using the tuning mechanism.

In light of the foregoing, since the sound field characteristic may be different due to the air permeability of the tuning holes, the air permeability of each tuning hole is changed by selectively shielding with the porous materials having different air permeability in the present invention, and a suitable air permeability of tuning hole is selected through the tuning mechanism according to the user's preference. Therefore, the user may adjust the frequency response of the earphone according to different music, such that the earphone can meet different users' requirements and it enhances the performance of the earphone.

Although the present invention has been described with reference to the above embodiments, it will be apparent to one of ordinary skill in the art that modifications to the described embodiments may be made without departing from the spirit of the invention. Accordingly, the scope of the invention will be defined by the attached claims and not by the above detailed descriptions.

What is claimed is:

1. An earphone, comprising:

a first housing having a containing space, a sound-output opening and a plurality of tuning holes, wherein the containing space communicates with outside of the first housing through the tuning holes, and areas of the tuning holes are substantially the same;

a speaker disposed at the sound-output opening and located in the containing space;

a plurality of porous materials, wherein an air permeability of each porous material are different and the porous materials cover the tuning holes correspondingly; and a tuning mechanism disposed at the first housing and shielding at least one of the tuning holes selectively.

2. The earphone as claimed in claim 1, wherein the tuning mechanism comprises a cover and a control button, the control button protrudes to outside of the first housing, and the control button is connected to the cover and used for driving the cover to shield at least one of the tuning holes.

3. The earphone as claimed in claim 1, further comprising a second housing covering outside the first housing and forming an external chamber with the first housing.

4. The earphone as claimed in claim 3, wherein the tuning mechanism comprises a cover and a control button, the control button protrudes to outside of the second housing, the cover is located on the first housing and connected to the control button, and the control button is used for driving the cover to shield at least one of the tuning holes.

5. The earphone as claimed in claim 3, wherein the second housing further comprises a vent, and the external chamber communicates with outside of the second housing through the vent.

6. The earphone as claimed in claim 1, wherein the porous materials are cloth.

7. The earphone as claimed in claim 1 is a circum-aural earphone.

8. The earphone as claimed in claim 1 is an in-ear type earphone.

9. An earphone, comprising:

a first housing having a containing space, a sound-output opening and a first tuning hole, wherein the containing space communicates with outside of the first housing through the first tuning hole;

a speaker disposed at the sound-output opening and located in the containing space;

a plurality of porous materials, wherein an air permeability of each porous material are different; and a tuning mechanism disposed at the first housing and having a plurality of second tuning holes, wherein areas of the second tuning holes are substantially the same, the porous materials cover the second tuning holes correspondingly, and the tuning mechanism selectively aligns one of the second tuning holes with the first tuning hole.

10. The earphone as claimed in claim 9, wherein the tuning mechanism comprises a cover and a control button, the cover has the plurality of second tuning holes, the control button protrudes to outside of the first housing, and the control button is connected to the cover and used for driving the cover to align one of the second tuning holes with the first tuning hole.

11. The earphone as claimed in claim 9, further comprising a second housing covering outside the first housing and forming an external chamber with the first housing.

12. The earphone as claimed in claim 11, wherein the tuning mechanism comprises a cover and a control button, the cover has the plurality of second tuning holes, the control button protrudes to outside of the second housing, the cover is located on the first housing and connected to the control button, and the control button is used for driving the cover to align one of the second tuning holes with the first tuning hole.

13. The earphone as claimed in claim 11, wherein the second housing further comprises a vent, and the external chamber communicates with outside of the second housing through the vent.

14. The earphone as claimed in claim 9, wherein the porous materials are cloth.

15. The earphone as claimed in claim 9 is a circum-aural earphone.

16. The earphone as claimed in claim 9 is an in-ear type earphone.

* * * * *